US005761780A

United States Patent [19]

Magi

[11] Patent Number: 5,761,780

[45] Date of Patent: Jun. 9, 1998

[54] DEVICE FOR THE RAPID APPLICATION OF PRECIOUS OR DECORATIVE STONES ON TO LAMINAR SUPPORTS

[75] Inventor: Raffaello Magi, Arezzo, Italy

[73] Assignee: Uno A Erre Italia S.p.A., Arezzo, Italy

[21] Appl. No.: 711,910

[22] Filed: Sep. 12, 1996

[30] Foreign Application Priority Data

Sep. 15, 1995 [IT] Italy ..... FI95A0198

[51] Int. Cl.[6] ..... B23P 5/00; B21F 43/00

[52] U.S. Cl. ..... 29/10; 29/896.42; 29/896.412; 292/80; 63/26

[58] Field of Search ..... 29/10, 896.412, 29/896.42; 63/26, 28, 29.1; 292/80

[56] References Cited

U.S. PATENT DOCUMENTS 1,573,899 2/1926 Armstrong ..... 63/29.1
3,350,764 11/1967 Geldwerth ..... 29/896.42
5,475,910 12/1995 Yamamoto ..... 29/10
5,535,506 7/1996 Chalfin ..... 29/10

FOREIGN PATENT DOCUMENTS 821446 10/1959 United Kingdom ..... 29/10

*Primary Examiner*—P. W. Echols
*Attorney, Agent, or Firm*—Hopgood, Caliamfde, Kalil & Judlowe

[57] ABSTRACT

A body (1) is machined in order to form: an axial cavity (5) for the stone the cavity having an edge (1B) that can be pressed over in order to anchor the stone; a lip (1E) that forms an abutment surface (1F) for resting against the surface of the laminar support (3) around a hole (4) formed in the support; adjacent to the lip (1E), a bearing section (9) that widens out and bears against the edge of the hole (4) in the support; and an elastic projection (11, 11A) that is joined to and extends from the section (9) and that can pass into the hole (4) and then re-expand so as to bear against the edge of the hole.

7 Claims, 2 Drawing Sheets

Fig. 1
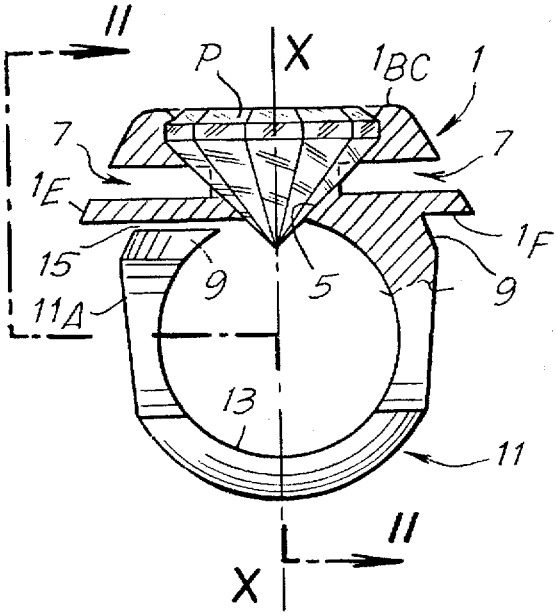
Fig. 2
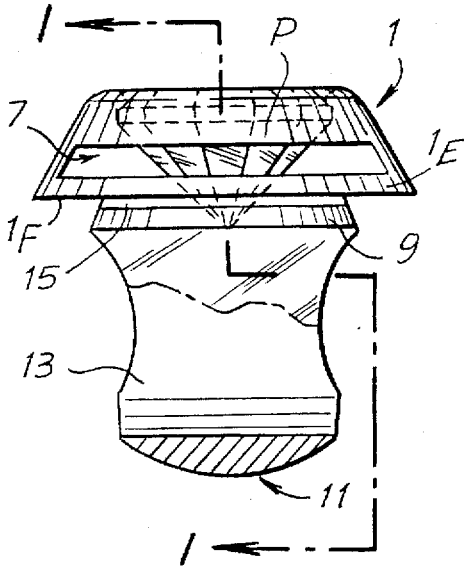
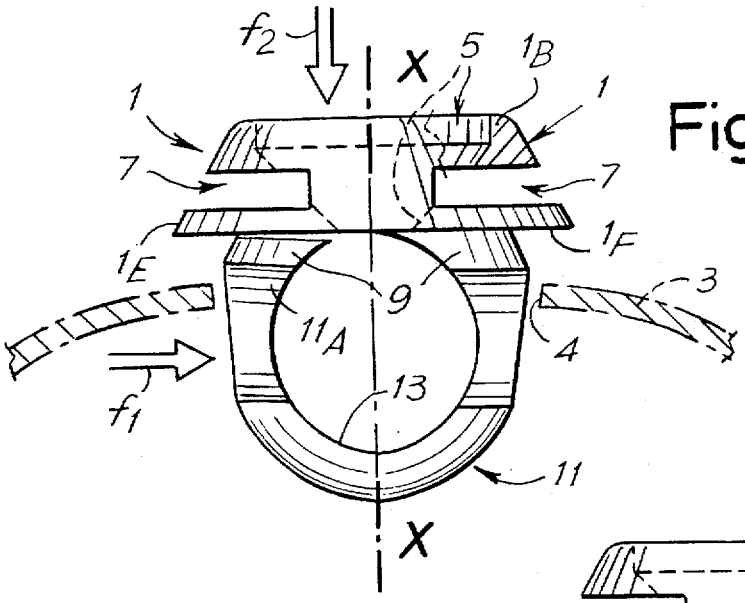
Fig. 3
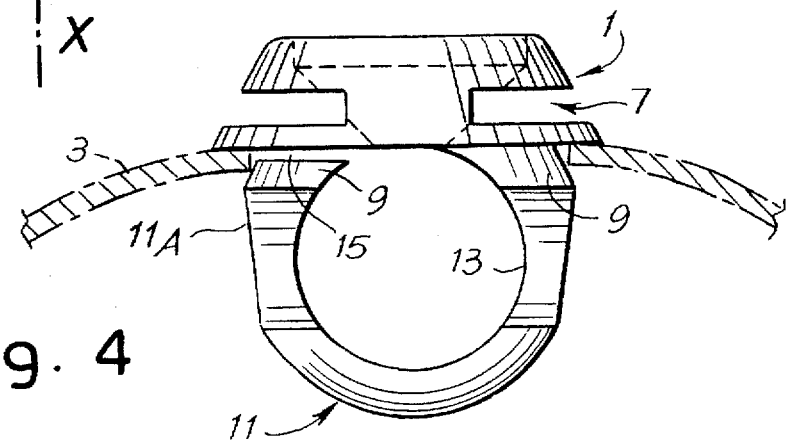
Fig. 4

DEVICE FOR THE RAPID APPLICATION OF PRECIOUS OR DECORATIVE STONES ON TO LAMINAR SUPPORTS

DESCRIPTION

The invention relates to a device for the rapid application of precious or decorative stones on to laminar supports, even very thin laminar supports, without the latter having to undergo any special preparation processes. The setting of even relatively tiny stones using cost-effective and rapid methods, is a problem which has yet to be solved, especially when these stones are to be applied on to laminar supports that are relatively very thin. Usually, additional components are fixed on to said supports by means of soldering and are then used to apply or form the setting. This method is expensive and is particularly difficult to implement on supports which are relatively very thin. The present device enables stones or other items to be applied quickly and easily, even on very thin supports or where other difficulties may be encountered with current conventional systems.

The invention also relates to a method for producing a device of the abovementioned type.

Basically, according to the invention, in a body which has been machined, by automatic or other means, there is formed an axial cavity for the stone or other item, said cavity having an edge that can be pressed over in order to anchor the stone; a projecting lip that forms an abutment surface for resting against the surface of the laminar support around a hole formed in said support; adjacent to said lip, and extending from said abutment surface, is a bearing section that widens out and bears against the edge of said hole in the support; and said bearing section forms part of an elastic projection that can pass into said hole in the support and then re-expand so as to bear against the edge of said hole.

Other characteristics of the invention are defined in the appended claims.

The invention will be understood more clearly by following the description and the appended drawing, which shows a practical and nonlimiting example of the invention. In the drawing:

FIG. 1 shows a view and partial cross-section on I—I in FIG. 2;

FIG. 2 shows a view and partial cross-section on II—II in FIG. 1;

FIG. 3 shows an external view of the operation to apply the body in question on to a laminar support;

FIG. 4 shows said body firmly attached on to its support;

Figure 5:
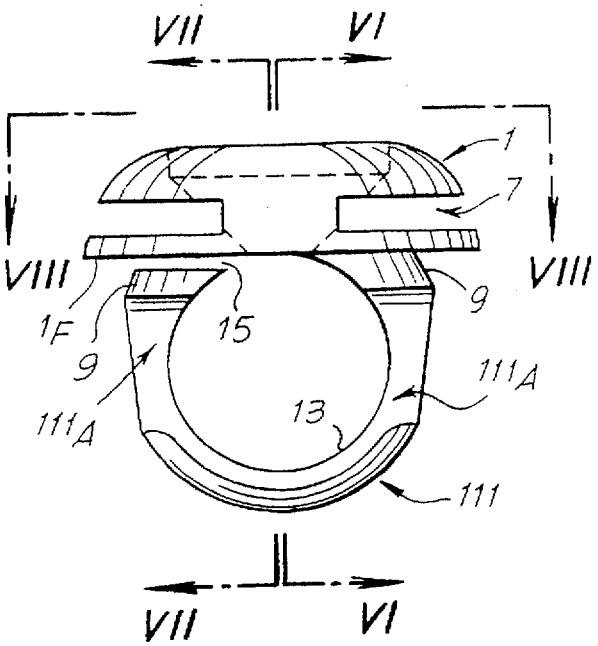
FIGS. 5, 6, 7 and 8 show a variant embodiment from the front and in cross-section on VI—VI, VII—VII and VIII—VIII, respectively, in FIG. 5.

As can be seen from the illustration of the appended drawing, and with initial reference to FIGS. 1 to 4, the reference numeral 1 denotes as a whole a body which is machined—for example from relatively thin bar—in order to obtain the mounting for a stone P (FIGS. 1 and 2), the stone being inserted in said body 1 which is then fixed on to a support 3 indicated by the dashed lines in FIGS. 3 and 4; this support 3 can, for example, be made of sheet gold, which may even be relatively very thin, and where all that is needed to apply the stone is for a hole 5 to be made (see FIG. 3). In this embodiment the body 1 is firstly machined by means of turning along the axis X—X in order to form a cavity 5 for the stone P; this cavity 5 has an annular edge 1B that can be deformed, that is pressed over, as may be seen by comparing FIGS. 1 and 3, where in FIG. 3 the edge 1B is shown before being pressed over and therefore before the stone P is applied, while in FIG. 1 the edge is denoted by 1BC and is shown after it has been deformed by pressing it over and therefore with the edge holding the stone in the cavity 5. In the region of the cavity 5, opposing transverse slits 7 are made, for example by milling, which extend right into the cavity 5. The purpose of these transverse slits 7, in addition to reducing the weight, that is the mass of precious metal from which the body 1 is made, is to allow light to penetrate into the cavity 5 and therefore into the stone P, which thus has a greater sparkle precisely because of the light which passes through said slits 7. The slits 7 define a lip 1E which forms an abutment surface 1F designed to rest against the support 3 around the hole 4. Formed adjacent to the abutment surface 1F and emerging from it is a tapered bearing section 9 which widens out from the abutment surface 1F and which, when it is produced by means of turning, will have a frustoconical shape. The bearing section 9 constitutes the initial part of an elastic projection 11, which is also made by means of turning and has a frustoconical guide portion that forms a continuation of the bearing section 9 and a terminal portion which can have a spherical domed shape. This particular shaping of the elastic projection 11 can be modified, as long as it forms some sort of guide projection that facilitates insertion of the body 1 into the hole 4 when it is applied to the support 3. In order to make the projection 11 elastic, as well as to reduce its weight, a relatively large hole 13 is transversely hollowed out of said projection 11, and extends into the surface delimiting the projection 11 so as further to shape the projection 11, as can be seen in FIG. 2, with respect to the outline that this projection 11 has in FIG. 1. In order to make said projection 11 elastic, as well as hollowing out the transverse through hole 13, a cut 15 is also made immediately under the abutment surface 1F, so as to separate one of the two branches that are defined in the projection 11 by the hole 13 and create in the projection 11 an extension element 11A which is rendered elastic and can therefore be deformed, especially inward, as may be seen by comparing FIGS. 1 and 3, when it is pressed in the direction of the arrow f1 shown in FIG. 3.

In short, the shaping of the body 1 is such that it, can be produced by machine, using automatic machines and relatively very simplified machining methods. A body 1 is obtained, the top part (when looking at the drawing) of which constitutes the cavity 5 for the stone P or other item, while below the abutment surface 1F it extends to form a projection which is elastic, by virtue of the free extension element 11A, and has a bearing section 9.

To apply the device, the stone P (or other item) is first positioned in the cavity 5 before the edge 1B is deformed, the edge 1B is then deformed by pressing it over, or by some other means, in order to obtain the shape 1BC shown in FIG. 1, thereby anchoring the stone P or other item. The body is then applied to the support by slightly deforming the extension element 11A by pressing it in the direction of the arrow $f_1$ so that it can be inserted into the hole 4 in the direction of the arrow $f_2$, and/or by pushing the body 1 directly in the direction of the arrow $f_2$ so that the projection 11 passes into the hole 4, the extension element 11A being deformed during the insertion. Once the body has been inserted, the abutment surface 1F rests on the external surface of the support 3 around the hole 4 and the edge of the hole 4 fits exactly—via the abutment action of the abutment surface 1F—against the bearing section 9 which, as the extension element 11A re-expands elastically in the direction opposite to that of the arrow $f_1$, bears against the edge of the hole 4, thereby securing the body 1 in the support 3, as may clearly be seen in FIG. 4.

The body 1 could be produced in a different way, in the sense that the same body could be shaped to form a cavity other than that 5 for an attached piece other than the stone P, or to form several cavities for a corresponding number of decorative components which are to be set in the body 1 before said body is applied to a support like the one 3. In that case, the body may also be made up of several identical bodies 1 which are suitably soldered into position in a desired arrangement of several stones P or other items applied together on the support 3. A larger hole may be made in the support 3, or several holes 4 may be made and positioned to correspond with the projections 11 of several bodies 1 which have been soldered together to form a composition.

Figure 6:
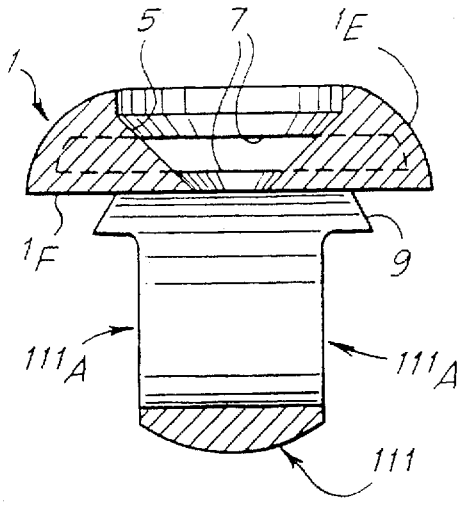
Figure 8:
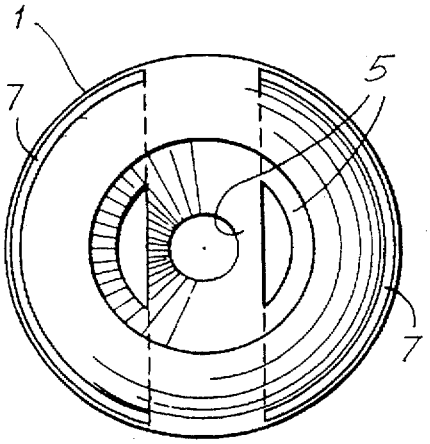
Figure 7:
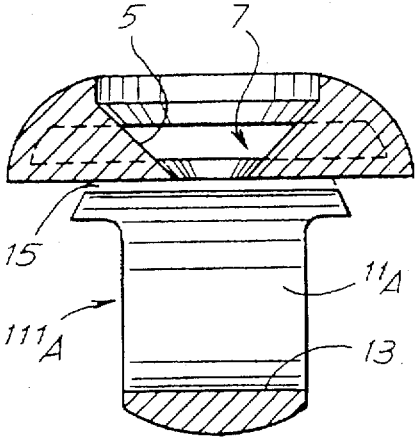

In the modified embodiment shown in FIGS. 5 to 7, the arrangement is basically the same and therefore the shaping of this modified body will not be described in detail. The same reference numerals have been used as in the preceding example, but only some of them have actually been shown in the drawing. The modification that has been made with respect to the version described in the first example basically involves the shaping of the projection that corresponds to the projection 11, which in this embodiment is denoted 111, and which instead of, or as well as, being machined by turning is also subjected to a flattening operation, as indicated by 11A, on opposite planes, which may be mutually parallel and perpendicular to the axis of the hole 13. This achieves a further thinning of the projection 11 which in turn means that it is easier to insert into the hole 4 in the support 3. Even with the flattened sections 111A, the extension element 11A formed in the manner already described in the preceding example still has a sufficient surface of tapered section 9 even in said elastic extension element 11A, even if the flattened section 111A is extended as far as the abutment surface 1F of the body 1.

It should be understood that the drawing shows only one example of the invention and is given solely by way of a practical demonstration, and that said invention can be modified in terms of its forms and arrangements without thereby departing from the scope of the concept underlying said invention.

I claim:

1. A device for the rapid application of a stone on to a laminar support, wherein the device comprises a body which has been machined, said body comprising:

a cavity for the stone, said cavity having an edge that can be pressed over in order to anchor the stone;

a lip that forms an abutment surface for resting against the surface of the laminar support around a hole formed in said support;

adjacent to said lip, a bearing section that widens out and bears against the edge of said hole in the support; and an elastic projection that is joined to and extends from said bearing section and that can pass into said hole in the support and then re-expand so as to bear against the edge of said hole.

2. The device of claim 1, which comprises, above said lip that forms the abutment surface, transverse slits that extend into said cavity for the stone effective to allow light to penetrate into said cavity.

3. The device of claim 1, wherein said elastic projection is formed by a section which tapers in the opposite direction to that of the cavity for the stone, has a transverse hole through it that turns it into a ring, and is cut so as to form an elastic extension element, on which a portion of the bearing section is located.

4. The device of claim 1, wherein said elastic projection has had its thickness reduced in the direction of the axis of the transverse hole by means of turning or, alternatively, by means of flattening.

5. A method for applying a stone on to a laminar support, comprising:

providing a body as defined by claim 1 having at least one cavity defined by an edge and adapted to receive said stone, and an elastic projection that can be deformed;

setting in said cavity a stone and thereafter deforming said edge effective to secure said stone in said cavity and provide a composite body;

providing a laminar support having at least one hole therein;

deforming said elastic projection effective to allow the projection to be inserted into the hole in the support; and inserting the deformed elastic portion of the composite body into the hole effective to provide a support having a stone applied thereto.

6. The method of claim 5, wherein said elastic projection is a ring-shaped projection made by means of turning, transverse boring, and lateral cutting to provide a central hole and lateral cutting effective to produce an open elastic ring, said lateral cutting being made adjacent to a lip that forms an abutment surface.

7. The method of claim 5, further comprising forming lateral slits in said cavity.

* * * * *